United States Patent [19]

Kubotera et al.

[11] 4,147,543

[45] Apr. 3, 1979

[54] DEVELOPER COMPOSITIONS FOR HIGH CONTRAST DIFFUSION TRANSFER PHOTOGRAPHIC MATERIALS AND PROCESS THEREFOR

[75] Inventors: Kikuo Kubotera; Eiichi Mizuki; Masato Satomura, all of Asaka; Haruhiko Iwano; Tadahiro Fujiwara, both of Minami-ashigara, Japan

[73] Assignee: Fuji Photo Film Co., Ltd., Minami-ashigara, Japan

[21] Appl. No.: 346,383

[22] Filed: Mar. 30, 1973

[30] Foreign Application Priority Data

Apr. 1, 1972 [JP] Japan ..... 47-32870

[51] Int. Cl.[2] ..... G03C 5/54

[52] U.S. Cl. ..... 96/29 R; 96/66 R; 96/76 R

[58] Field of Search ..... 96/66, 66.3, 66.5, 109, 96/50, 29

[56] References Cited

U.S. PATENT DOCUMENTS

| | | | |
|---|---|---|---|
| 3,147,118 | 9/1964 | Dersch | 96/109 |
| 3,502,472 | 3/1970 | Willems | 96/66.3 |
| 3,607,269 | 9/1971 | Young | 96/29 |
| 3,615,488 | 10/1971 | Drago | 96/50 |
| 3,687,669 | 8/1972 | Iijima | 96/66.3 |
| 3,708,299 | 1/1973 | Shimamura | 96/66.3 |

*Primary Examiner*—Roland E. Martin, Jr.
*Assistant Examiner*—John L. Goodrow
*Attorney, Agent, or Firm*—Sughrue, Rothwell, Mion, Zinn and Macpeak

[57] ABSTRACT

Developer compositions for diffusion transfer photographic materials containing amino compounds and imidazole compounds are used in a diffusion transfer photographic process for obtaining litho-type positive images of high contrast and of good short toe effect, the amino compounds being represented by the following formula I and the imidazole compounds by the following formula II:

Formula I (a) $NH_2—C_mH_{2m}—X$ wherein X represents a hydrogen atom, hydroxyl group, carboxyl group or amino group, and m represents a natural number of 0–12, but X represents a hydroxyl group when m is 0, wherein X and X′ represent each a hydrogen atom, hydroxyl group, carboxyl group or amino group, and m and each represents a natural number of 0–12, but X and/or X′ represents a hydroxyl group when m and/or n is 0.

wherein Y represents an oxygen atom, $—CH_2—$ or —NR′, R and R′ each represents a hydrogen atom, acyl group, alkyl group or substituted alkyl group, and p represents 2 or 3

Formula II wherein $R_1$ represents a hydrogen atom, alkyl group, substituted alkyl group, vinyl group or allyl group, $R_2$ represents a hydrogen atom, alkyl group or substituted alkyl group, $R_3$ represents a hydrogen atom or alkyl group, and $R_4$ represents a hydrogen atom, alkyl group or substituted alkyl group. A developing process using the same is also disclosed.

25 Claims, 3 Drawing Figures

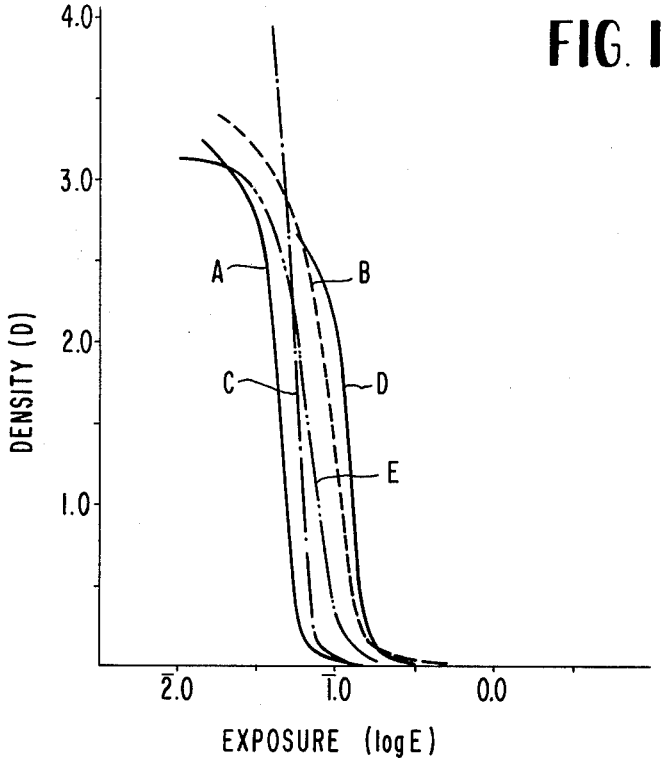
FIG. 1
FIG. 2
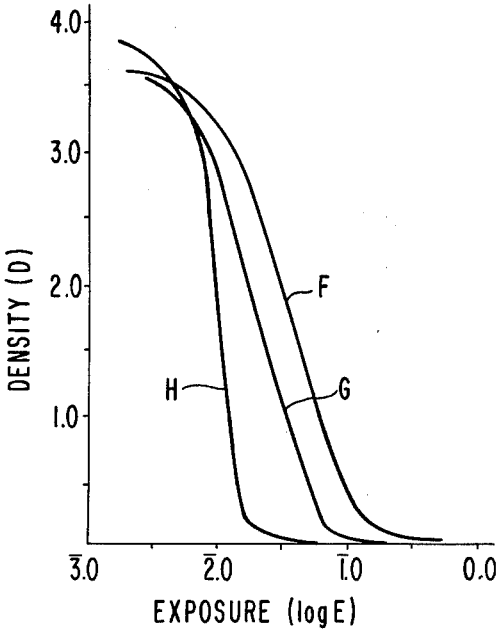
FIG. 3
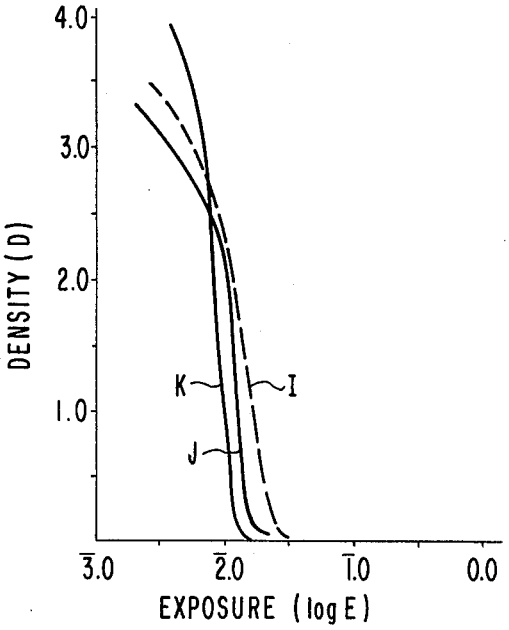

DEVELOPER COMPOSITIONS FOR HIGH CONTRAST DIFFUSION TRANSFER PHOTOGRAPHIC MATERIALS AND PROCESS THEREFOR

BACKGROUND OF THE INVENTION

1. Field of the Invention

The present invention relates to developer compositions for high contrast diffusion transfer photographic materials and to a developing process using the same. In more detail, the present invention relates to developer compositions for producing high contrast images by a diffusion transfer process.

2. Description of the Prior Art

In general, in the graphic arts field high contrast photosensitive materials are used in order to photographically produce line images and half-tone images (half-tone dot images). For example, a half-tone image is produced by printing an original having a continuous tone onto a litho-type photographic sensitive material through a screen and developing using a developer called an infectious developer (see "Photographic Processing Chemistry" pages 163–165, issued by Focal Press Co., 1966).

The operation of an infectious developer can be illustrated as follows. When a litho-type photosensitive material is developed using a so-called litho-type developer solution consisting of, as the main ingredients, hydroquinone and formaldehyde-bisulfite, which is a buffer agent for decreasing the amount of bisulfite ion, the hydroquinone reduces silver halide particles as the development proceeds, and as a result the hydroquinone itself changes to semi-quinone. The thus changed semi-quinone is chemically more unstable than the hydroquinone and has a stronger reductivity, and thus the development is extremely accelerated due to the existence of the semi-quinone. Accordingly, as the development proceeds, the amount of the semi-quinone further increases and, as the result thereof, the development further proceeds. Thus, this kind of infectious developer solution can impart an extremely high gamma-value of about 8–15. By using such a developer solution, the development and the blackening are successively carried out, and this kind of development is called an infectious development.

However, since the process for developing a litho type sensitive material is a negative-negative process, it is not possible to produce images by a positive-positive process. Accordingly, in the case of producing images by a positive-positive process, for example, in the case of producing positive images from a negative original, printing has been carried out using an intermediate separated negative. Therefore, it would be economically advantageous if line images and half-tone images could be directly produced from an original without the necessity of producing an intermediate negative.

SUMMARY OF THE INVENTION

Accordingly, one object of the present invention is to provide developer compositions for producing high contrast images by a positive-positive process.

A second object of the present invention is to provide developer compositions for producing line images and half-tone images by a diffusion transfer process.

A third object of the present invention is to provide developer compositions for producing half-tone dot images having excellent half-tone photographic properties.

A fourth object of the present invention is to provide developer compositions having excellent preservability.

A fifth object of the present invention is to provide a diffusion transfer process for forming high contrast images.

As the result of many studies, the present inventors have found that the above-mentioned objects can be attained by adding one or more amine compounds and one or more imidazole compounds to a diffusion transfer developer as is known to the prior art, that is, the present invention relates to developer compositions for a silver salt diffusion transfer process which are characterized by containing one or more amine compounds and one or more imidazole compounds.

BRIEF DESCRIPTION OF THE DRAWINGS

FIG. 1–FIG. 3 are characteristic curves which show the synergistic effect of the present invention.

DETAILED DESCRIPTION OF THE INVENTION

According to the silver salt diffusion transfer process (see, e.g., U.S. Pat. Nos. 2,698,237; 2,698,238; 2,698,245; 2,774,667; 2,823,122; 3,396,018; 3,369,901; 769,552; and 2,352,014) silver halide in the exposed part of a negative material is developed by a developing agent in the developer while silver halide in the unexposed part reacts with a silver halide solvent in the developer to form a soluble silver complex salt which diffuses into the positive material (image receiving layer) and deposits in a silver depositing nuclei-containing layer of the positive material to form silver images. Though this process is well known in the art, the resulting positive images obtained by this process have a very low contrast. Therefore, it is not possible to produce line images and half-tone images for use in the graphic arts field by this process. For example, if the diffusion transfer process is utilized for producing half-tone dot images, a density gradient part (called, fringe) which is disadvantageous for plate making is formed.

However, if amino compounds (Formula I*a*, I*b* or I*c*) and imidazole compounds (Formula II) are added to the above mentioned developer, the contrast of the resulting positive images increases remarkably and areas having an intermediate density are not produced. Further, the exposed range of the foot part of the characteristic curve is shortened (hereinafter called foot-cutting).

Formula I*a*

$$NH_2-C_mH_{2m}-X$$

(In the formula, X represents a hydrogen atom, hydroxyl group, carboxyl group or amino group, and m represents 0 or an integer of 1–12, but X is a hydroxyl group when m is 0.)

$$NH\begin{cases} C_mH_{2m}-X \\ C_nH_{2n}-X' \end{cases}$$

(In the formula, X and X′ each represents a hydrogen atom, hydroxyl group, carboxyl group or amino group, and m and n are each 0 or an integer of 1–12, but X and/or X' represents a hydroxyl group when m and/or n is 0.)

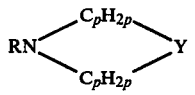

(In the formula, Y represents an oxygen atom, —$CH_2$— or —NR', R and R' each represent a hydrogen atom, acyl group, alkyl group or substituted alkyl group, and p is 2 or 3).

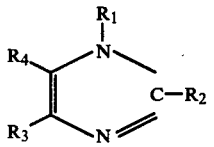

(In the formula, $R_1$ represents a hydrogen atom, alkyl group, substituted alkyl group, vinyl group or allyl group, $R_2$ represents a hydrogen atom, alkyl group or substituted alkyl group, $R_3$ represents a hydrogen atom or alkyl group, and $R_4$ represents a hydrogen atom, alkyl group or substituted alkyl group.)

The alkyl or substituted alkyl group in either of formula I or II can be any such group which imparts water or alkaline solubility to these compounds. Generally, such groups contain up to 12 carbon atoms in the alkyl moiety (substituted or unsubstituted). For example, lauryl ($C_{12}$ alkyl) substituted imidazole is considered fully water soluble in view of the fact that lauryl pyridinium chloride is water soluble. Preferred substituted alkyl groups are hydroxyl, carboxyl, acyl and aryl substituted alkyl groups with a $C_1$ to $C_{12}$ alkyl moiety.

As examples of the compounds represented by the above formulae I*a*–I*c*, there are hexamethylenediamine, cyclohexylamine, glycine, hydroxylamine, ethanolamine, diisopropanolamine, N-methylethanolamine, diethanolamine, 2-amino-2-methyl-1,3-propanediol, dimethylamine, diethylamine, diisobutylamine, N-methylbenzylamine, piperazine, aminoethylpiperazine, dimethylpiperazine, hydroxyethylmorpholine and methylpiperazine. The compounds represented by formulae I*a* to I*c* may be water soluble salts such as alkali metal salts and ammonium salts.

As examples of the compounds represented by formula II (including quaternary salts), there are imidazole, 2-methylimidazole, 2,4-dimethylimidazole, 2-ethyl-4-methylimidazole, 2-amylimidazole, 1-isoamyl-2-methylimidazole, 4,5-dimethylimidazole, 2-ethylimidazole, 1-methylimidazole, 2,4,5-trimethylimidazole, 4-hydroxymethyl-5-methylimidazole, 4-(2-hydroxyethyl)-5-methylimidazole, 1-allyl-2-methylimidazole, 1-vinyl-2-methylimidazole, 1-vinyl-2-methylimidazole methyl tosylate, 1-benzyl-2-methylimidazole methyl tosylate and 1-benzyl-2-methylimidazole methyl iodide. The compounds represented by the formula II may, of course, contain alkyl groups which are substituted by substituents such as a hydroxyl group, carboxyl group, acyl group or aryl group.

It is sufficient if at least one compound from formulae I*a*–I*c* and one compound from formula II described above is included in the developer. However, since the necessary quantity varies depending upon the kind thereof, they are used in a suitable concentration for obtaining the desired result. An effective range as to the total amount of two or more kinds thereof is from about 1 g to 250 g per liter of developer, and particularly from about 10 g to 150 per liter of developer.

The amino compounds and the imidazole compounds may be used in any desired amounts, and in particular, the preferred amounts are as follows: The content of the amino compounds is 40–98% and that of the imidazole compounds is 2–60%, by weight of amino compound(s) plus imidazole compound(s).

The amine compounds and the imidazole compounds used in the present invention are all soluble in aqueous alkali media. Therefore, the developer of the present invention can be produced by merely adding these compounds to a known diffusion transfer developer or to an aqueous solution together with a developer composition. Further, these compounds are not only stable in aqueous alkali solutions but also have the characteristic of promoting the preservability of the developer. Accordingly, they are advantageous from the viewpoint of increasing the stability of the developer.

The diffusion transfer developer compositions used in the present invention have essentially the same composition as known diffusion transfer developers but they contain one or more of the amino compounds and one or more of the imidazole compounds.

In general, a developer solution for the diffusion transfer process consists of the following ingredients: (1) developer; (2) silver halide solvent; (3) development accelerator; (4) preservative; (5) retarder; (6) anti-fogging agent, etc.

With respect to the developer, these are generally an organic reducing agent and act to reduce the latent image formed in the silver halide layer to form a visible silver (metal) image. In general, benzene derivatives, napthalene derivatives and the like having a reducing function are used. In the present invention, particularly preferred combinations of the developers used are 3-pyrazolidone compounds or aminophenol compounds and polyhydroxybenzene compounds.

Representative examples of these compounds are mentioned hereunder.

3-pyrazolidone compounds ($A_1$):

1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chloro-phenyl-3-pyrazolidone, etc.

Aminophenyl compounds ($A_2$):

N-methyl-p-aminophenol, p-aminophenol, 2,4-diaminophenol, p-benzylaminophenol, 2-methyl-p-aminophenol and 2-hydroxymethyl-p-aminophenol, etc.

Polyhydroxybenzene compounds (B):

hydroquinone, catechol, chlorohydroquinone, pyrogallol, bromohydroquinone, isopropylhydroquinone, toluhydroquinone, methylhydroquinone, 2,3-dichlorohydroquinone, 2,5-dimethyl-hydroquinone and 2,3-dibromo-hydroquinone, etc.

In a diffusion transfer development, the latent image which has been formed by the exposure is developed in the negative layer consisting of a silver halide emulsion, and almost at the same time the unexposed silver halide in the negative emulsion layer is reacted with the silver halide solvent to form a diffusible silver complex salt, the amount of which depends upon that of the exposed silver halide, and the thus formed silver complex salt is diffused into the image receiving layer where the diffused salt is contacted with colloidal nuclei and reduced to form a silver image therein. Accordingly, the silver halide solvent in question is added for the diffusion of the silver complex salt, and can be, for example, an alkali metal thiosulfate such as sodium thiosulfate, potassium thiosulfate, etc., an alkalithiocyanate, an alkaliselenocyanate, a thioglycol, an aminoethane thiol, etc.

Development accelerators: basic substances are used to activate the developing agent. Useful alkaline substances are, for example, inorganic alkaline agents such as sodium phosphate, etc., and ammonia, etc. The pH value of the developer solution is preferably kept in the range of 9–13, better yet 9.5–13.

With respect to the antioxidant, the developer reacts with oxygen in the air losing its developing activity, which results in a decrease of the speed of development. Accordingly, the effect of the developing agent is extremely reduced. In order to eliminate such an unfavorable phenomenon, generally an antioxidant is used in the developer composition. Representative examples of such antioxidants are, for example, sulfites such as sodium sulfite or acid sodium sulfite, sodium metabisulfite, etc.

With respect to the retarders, in general, potassium bromide is added to the developer solution to restrain the dissociation of silver halides, whereby the silver ion concentration is lowered. Due to the addition of such a development retarder, the development is appropriately retarded to restrain the occurrence of fog.

An anti-fogging agent, in general, potassium bromide, is usually added the developer solution. In addition, benzimidazole derivatives and the like are used in strong developer solutions. Examples of such anti-fogging agents include nitroimidazole, oxazoles, thiazoles, triazoles, tetrazoles, thioanilides, thioglycols, etc.

The most commonly encountered of such developer solutions which find use in the present invention can be described in tabular form as follows (all figures are grams/liter of developer solution):

| | Prior Art | | Present Invention | |
|---|---|---|---|---|
| | Generally Used Range | Perferred Range | Generally Used Range | Preferred Range |
| Mandatory Components | | | | |
| Developer $A_1$ or $A_2$ | 0.01–20 | 0.5–5 | 0.01–20 | 0.5–5 |
| Developer B | 1–50 | 3–20 | 1–50 | 3–20 |
| Alkaline agent | 1–100 | 5–100 | 1–100 | 5–100 |
| Silver halide solvent | 1–100 | 5–30 | 1–100 | 5–30 |
| Amine compound | | | 0.5–250 | 5–150 |
| Imidazole compound | 0.001–1 (This has hitherto been used as an optional component.) | 0.01–0.5 | 1–250 | 1–50 |
| Preferred Optional Components | | | | |
| Preservative | 1–200 | 5–100 | 1–200 | 5–100 |
| Optional Components | | | | |
| Anti-fogging agent | 0.001–1 | 0.01–0.5 | 0.001–1 | 0.01–0.5 |
| Retarder | 0.1–10 | 0.5–3 | 0.1–10 | 0.5–5.0 |

Useful developer compositions are also described in, for example, U.S. Pat. Nos. 2,543,181, 2,662,822 and 2,857,276.

In general, preservatives such as sulfites, sulfite ion buffers such as sulfite addition products, halides such as potassium bromide, alkali agents such as sodium hydroxide, or other commonly used additives such as antifogging agents, surface active agents and water softeners (e.g. sodium hexametaphosphate and ethylenediamine tetraacetic acid) are included in the developer composition, if desired.

The pH of the developer compositions of the present invention at use is in the alkaline region, preferable at pH 9.5–13.0.

The developer compositions of the present invention can be used as a liquid developer, a condensed liquid developer containing organic solvents, etc., as a viscous developer containing hydrophilic resins or as a powder developer where the components are mixed. In other words, if the developer containing the amino compounds and the imidazole compounds is used at development, it is included within the scope of the present invention.

Regarding the hydrophilic resins:

In greater detail, the developer compositions of the present invention may optionally contain any hydrophilic alkaline-soluble resin which does not harm the active developer components. The preferred resins are, for example, methyl cellulose, carboxymethyl cellulose, hydroxyethyl cellulose, ethyl cellulose, alginates, polyvinyl alcohol, polyvinyl pyrrolidone, etc.

When the developer solutions of the present invention are preserved in the form of highly concentrated solutions dissolved in oganic solvents, concentrated solutions are diluted with water in desired proportions on use. For the preparation of such concentrated developer solutions, hydrophilic organic solvents are used wherein the respective components are dissolved. These organic solvents must be sufficiently water miscible, and are, for example, glycols such as ethylene glycol, diethylene glycol, triethylene glycol, tetraethylene glycol, etc., Cellosolve such as methyl Cellosolve, ethyl Cellosolve, etc., alcohols such as methyl alcohol, ethyl alcohol, propyl alcohol, butyl alcohol, etc., and ketones such as acetone, methyl ethyl ketone, etc. These organic solvents are preferably used in an amount of 5–300 g per 1000 cc of the used developer. In general, the concentration degree of the developer is about 2–5 fold strength.

As the photosensitive materials treated with the developer compositions of the present invention, photosensitive materials in which an image receiving material containing silver diffusion transfer nuclei (image receiving layer) is separate from a silver halide photosensitive material (negative emulsion layer) and multi-layer sensitive materials in which a photosensitive silver halide emulsion is applied directly to an image receiving material can be used.

As the photosensitive silver halide emulsion layer, any kind known in this field can be used, but it is preferred to use those in which the exposed silver salt is developed quickly while the unexposed silver salt quickly forms a complex compound which is reduced rapidly in the image receiving layer. As the silver halide, silver chloride, silver bromide, silver iodide, silver bromochloride, silver iodochloride and silver iodobromochloride are commonly used, and while gelatin is mainly used as the binder, gelatin derivatives such as phthalated gelatin, hydrophilic polymers such as polyvinyl alcohol and polyvinylpyrrolidone and the like, and mixtures thereof, can also be used. It is preferred that the ratio of silver halide to binder be high, and a ratio by weight of 0.4–0.6 or so is especially, advantageous in order to produce portraits used in the field of the graphic arts.

If desired, additives as are commonly used such as sensitizers, sensitizing dyes, antifogging agents, hardeners, surface active agents and other additives can be added to the silver halide emulsions.

In short, so long as the photosensitive materials which are treated with the developer compositions of the present invention are high contrast photographic emulsions the objects of the present invention can be met.

As the medium of the image receiving layer in which the nuclei substance for physical development is dispersed, any material which has hitherto been used in this field can be used, typically gelatin. As the nuclei substance, there are, for example, colloidal silver, silver sulfide, nickel sulfide, zinc sulfide, sodium sulfide, colloidal sulfur, thiosinamine, stannous chloride and chloroauric acid, and the like, all of which are well known nuclei substances.

Hitherto, it has been known that many effects result from adding the above mentioned compounds to photographic elements and compositions, and they have been put to practical use. In the case of the amino compounds in diffusion transfer developers, adding sulfone hydroxylamine as the effective developing agent is disclosed in U.S. Pat. No. 3,287,124; improving the preservability of the treating solution and the preservability of positive images by adding hydroxylamine hydrochloride to the treating solution is disclosed in British Pat. No. 1,178,713; and aliphatic amines as the alkali agent of the developer are disclosed in U.S. Pat. No. 3,386,825.

Further, with respect to adding amino compounds to common developers, using alkali metal salts of triethanolamine as the alkali agent is disclosed in U.S. Pat. No. 2,017,167; adding a developing agent and a salt of a primary, secondary or tertiary aliphatic amine as the developer for forming fine particle images is disclosed in U.S. Pat. No. 2,113,312; adding triethanolamine in order to increase the preservability of the developer is disclosed in U.S. Pat. No. 2,657,138; adding hydrazine and triethanolamine in order to shorten the time of development without changing the granularity and contrast of the developer is disclosed in U.S. Pat. No. 2,882,152; adding ammonia derivatives having hydroxyalkyl groups in order to control alkalinity and to prepare a developer having a high concentration is disclosed in British Pat. No. 430,916; and adding triethanolamine to a one-bath type development fixer is disclosed in British Pat. No. 571,389.

With respect to the imidazole compounds, it has been known that imidazole and imidazole derivatives function to control fogging when added to the photographic elements and compositions and to delay the development rate and to change the color tone of the developer (see "Photographic Chemistry" page 98, item 7, written by Shinichi Kikuchi). Thus, the imidazoles have been put to wide practical use. Further, it has recently been disclosed that if silver halide photosensitive materials are developed in the presence of alkyl substituted or hydroxyalkyl substituted imidazoles, the development is accelerated (French Pat. No. 2,029,043).

However, the developer compositions containing both of the above mentioned compounds have the relationship of complementing each others photographic characteristics and show a cooperative or synergistic effect in increasing contrast and foot-cutting. These effects could not be expected from the prior art. Furthermore, the defects observed in the case of using these compounds alone, that is, lack of color tone at high density areas, lack of development acceleration and increased cost due to use alone in a large amount, are all avoided.

It should be particularly noticed that in the case of forming a half-tone dot image that the resulting half-tone image has the same quality as that of the image obtained by using the common high contrast photosensitive materials because fringe extremely decreases. It is also possible to produce positive half-tone dot images.

Furthermore, when the developer composition of the present invention is applied to a multi-layer diffusion transfer photosensitive material, a negative emulsion layer is easily stripped from an image receiving layer for forming positive images because hardening of the negative emulsion layer by quinones is obstructed.

As described above, the present invention has industrial importantance because the developer compositions of the present invention impart practical effects which could not have been predicted or foreseen from the prior art. Accordingly, the present invention is useful in the field of obtaining positive line images and half-tone images.

Several non-limiting examples will now be set out.

EXAMPLE 1

After treating the surfaces of a polyethylene terephthalate film 0.18 mm thick with a solution containing sulfuric acid, phosphoric acid and potassium bichromate:

| | | |
|---|---|---|
| $H_2SO_4$ | 400cc | 50° C., film immersed for 3 minutes |
| $H_3PO_3$ | 200cc | |
| $K_2Cr_2O_7$ | 70g | |
| Water to make | 3000cc | |

an antihalation layer was applied to one surface and a gelatin-organic solvent dispersion having the following composition was applied to the other surface and dried at 120° C. for 2 hours to produce an intermediate layer having a 0.2μ thickness.

| | |
|---|---|
| Gelatin | 1g |
| Water | 1g |
| Acetic acid | 1g |
| Methanol | 20g |
| Acetone | 60g |
| Methylene chloride | 10g |
| Tetrachloroethane | 5g |
| Phenol | 5g |

To the coated surface, an aqueous gelatin solution containing a nuclei substance for physical development having the following composition was applied and dried at 60° C. for 60 minutes to produce a hydrophilic diffusion transfer image receiving layer having a 0.5μ thickness.

| | |
|---|---|
| Nickel sulfide gelatin dispersion (Nickel sulfide $5 \times 10^{-4}$ wt % (size: 10–500A) Gelatin 0.5 wt (%) | 0.4g |
| Gelatin | 0.4g |
| Water | 100g |
| 1% Aqueous solution of sodium dodecylbenzene sulfonate | 0.4g |
| 1% Aqueous solution of chromium acetate | 0.4g |

To this image receiving layer, a litho-type panchromatically sensitized high contrast unhardened gelatin-silver bromochloride emulsion (70 mol % silver chloride, containing 1 mol of silver per 1 kg of the emulsion) was applied and dried to form a film having a 5μ thickness. Further, a 1% aqueous gelatin solution was applied so as to form a protective layer having a 1μ thickness and dried to produce a photosensitive material.

Using this photosensitive material, positive images formed of silver were produced by photographing a sensitometric step-wedge, treating using diffusion transfer developers having the following 5 compositions at 20° C. for one minute, washing with water at 30° C. and removing the emulsion layer. The results are shown in Table 1.

| Composition of developer | A | B | C | D | E |
|---|---|---|---|---|---|
| 1-Phenyl-3-pyrazolidone (g) | 2.0 | 2.0 | 2.0 | 2.0 | 2.0 |
| Hydroquinone (g) | 15 | 15 | 15 | 15 | 15 |
| Anhydrous sodium sulfite (g) | 80 | 80 | 80 | 80 | 80 |
| Anhydrous sodium thiosulfate (g) | 10 | 10 | 10 | 10 | 10 |
| Sodium hydroxide (g) | 15 | 15 | 15 | 15 | 15 |
| Potassium bromide (g) | 1 | 1 | 1 | 1 | 1 |
| Diethanolamine (g) | — | 30 | 30 | 120 | 120 |
| Imidazole (g) | 10 | — | 10 | — | 10 |
| Water to make | 1 liter | 1 liter | 1 liter | 1 liter | 1 liter |

The pH of the developer solution was about 12.5.

Referring to FIG. 1, the curves A and D show the optimum amounts of the respective compounds to impart maximum efficiency when each compound is used alone. Curve E shows the optimum amount of both compounds, that is, when the compounds are used together; in addition, curve C shows the proportions which impart maximum efficiency when both compounds are used together. By comparison of curves E and C, it can be seen that the maximum efficiency can be attained by reducing the amount of the diethanolamine from 120 g to 30 g, due to the synergistic effct of both compounds. Curve B shows the effect resulting from the use of only the diethanolamine, which, on the other hand, shows maximum efficiency in curve C where the amine is used together with imidazole.

By comparison of Curves A–E, it can be seen that the effect of the present invention in which the amine compound and the imidazole compound are used together is excellent.

It can also be seen that the maximum density increases, the contrast is high and the foot-cutting is improved by using the two compounds together.

In the drawings, the D value shows the optical density and the log E value shows the relative log E (meter-candle-second).

EXAMPLE 2

Developers having the following compositions were prepared, and the same procedure as in Example 1 was carried out.

| | F | G | H |
|---|---|---|---|
| 1-Phenyl-3-pyrazolidone (g) | 2.0 | 2.0 | 2.0 |
| Hydroquinone (g) | 25 | 25 | 25 |
| Anhydrous sodium sulfite (g) | 60 | 60 | 60 |
| Sodium hydroxide (g) | 15 | 15 | 15 |
| Anhydrous sodium thiosulfate (g) | 15 | 15 | 15 |
| Potassium bromide (g) | 1 | 1 | 1 |
| Diethanolamine (g) | 0 | 30 | 30 |
| Imidazole (g) | 10 | 0 | 10 |
| Water to make | 1l | 1l | 1l |

The pH of the developer solution was about 12.5.

The photographic characteristics obtained after development are shown in FIG. 2.

As is clear from FIG. 2, the developer of the present invention in which diethanolamine and imidazole are used together (curve H) provides a high gamma value, good foot-cutting and high sensitivity.

EXAMPLE 3

Developers having the following compositions were prepared, and the same procedure as in Example 1 was carried out.

| | I | J | K |
|---|---|---|---|
| 1-Phenyl-3-pyrazolidone (g) | 2.0 | 2.0 | 2.0 |
| Hydroquinone (g) | 15 | 15 | 15 |
| Anhydrous sodium thiosulfate (g) | 15 | 15 | 15 |
| Ascorbic acid (g) | 10 | 10 | 10 |
| Potassium bromide (g) | 1 | 1 | 1 |
| Hydroxylamine sulfate (g) | 0 | 20 | 20 |
| 2-Methylimidazole (g) | 1 | 0 | 1 |
| 0.5% Aqueous methanol solution of 1-phenyl-5-mercaptotetrazole (cc) | 2 | 2 | 2 |
| pH adjusted by adding sodium hydroxide to | 11.0 | 11.0 | 11.0 |
| Water to make | 1l | 1l | 1l |

The photographic characteristics resulting from the development are shown in FIG. 3.

As is clear from FIG. 3, the developer of the present invention in which hydroxylamine and 2-methylimidazole are used together (curve K) has high maximum density, a high gamma value and good foot-cutting.

While the invention has been described in detail and with reference to specific embodiments thereof, it will be apparent to one skilled in the art that various changes and modifications can be made therein without departing from the spirit and scope thereof.

What is claimed:

1. A developer composition for high contrast diffusion transfer photographic materials which comprises (1) a developing agent, (2) a silver halide solvent, (3) an alkaline agent, (4) an amino compound represented by the following formula Ia, Ib or Ic or a mixture thereof, and (5) a mercapto-group free imidazole compound represented by the following formula II or a mixture thereof;

Formula I (a) $NH_2—C_mH_{2m}—X$ wherein X represents a hydrogen atom, a hydroxyl group, a carboxyl group or an amino group, and m represent a natural number of 0–12, but X represents a hydroxyl group when m is 0,

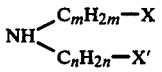

wherein X and X′ each represents a hydrogen atom, a hydroxyl group, a carboxyl group or an amino group, and m and n each represents a natural number of 0–12, but X and/or X′ represents a hydroxyl group when m and/or n is 0,

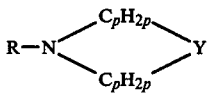

wherein Y represents an oxygen atom, $—CH_2—$ or —NR′, R and R′ each represents a hydrogen atom, an acyl group, an alkyl group or a substituted alkyl group, and p represents 2 or 3,

FORMULA II

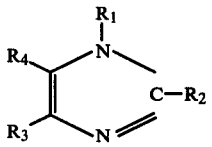

wherein $R_1$ represents a hydrogen atom, an alkyl group, a substituted alkyl group, a vinyl group or an allyl group, $R_2$ represents a hydrogen atom, an alkyl group or a substituted alkyl group, $R_3$ represents a hydrogen atom or an alkyl group, and $R_4$ represents a hydrogen atom, an alkyl group or a substituted alkyl group, said developer composition providing images of high contrast and good short toe effect.

2. The developer composition for high contrast diffusion transfer photographic materials as claimed in claim 1 where the total amount of amino compound(s) of formula I and imidazole compounds of formula II is about 1 g to about 250 g per liter of developer.

3. The developer composition for high contrast diffusion transfer photographic materials as claimed in claim 2 where the amount is 10 to 150 g per liter of developer.

4. The developer composition for high contrast diffusion transfer photographic materials as claimed in claim 2 where the content of the amino compound of the formula I is 40–98% and the content of the imidazole compound of the formula II is 60–2%, by weight of the total weight of the amino compound of the formula I and the imidazole compound of the formula II.

5. The developer composition for high contrast diffusion transfer photographic materials are claimed in claim 4 where the pH of the developer composition is 9.0 to 13.

6. The developer composition for high contrast diffusion transfer photographic materials as claimed in claim 1 where the developing agent is present in an amount of from 1.01–70, the silver halide solvent is present in an amount of from 1–100 and the alkaline agent is present in an amount of from 1–100, all in g per liter of developer composition.

7. The developer composition for high contrast diffusion transfer photographic materials as claimed in claim 6 where the developing agent comprises (1) a 3-pyrazolidone or an aminophenyl compound and (2) a polyhydroxybenzene, present in an amount of 0.01–20 of (1) and 1–50 of (2), all in g per liter of developer composition.

8. The developer composition for high contrast diffusion transfer photographic materials as claimed in claim 7 where the 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chloro-phenyl-3-pyrazolidone, the amino phenol compound is selected from the group consisting of N-methyl-p-aminophenol p-aminophenol, 2,4-diaminophenol, p-benzylaminophenol, 2-methyl-p-aminophenol and 2-hydroxymethyl-p-aminophenol, and the polyhydroxybenzene compound is selected from the group consisting of hydroquinone, catechol, chlorohydroquinone, pyrogallol, bromohydroquinone, isopropylhydroquinone, toluhydroquinone, methyl-hydroquinone, 2,3-dichloro-hydroquinone, 2,5-dimethyl-hydroquinone and 2,3-dibromo-hydroquinone.

9. The developer composition for high contrast diffusion transfer photographic materials as claimed in claim 1 where any alkyl group or substituted alkyl group present renders said compound water-soluble.

10. The developer composition for high contrast diffusion transfer photographic materials as claimed in claim 9 where the alkyl moiety of any alkyl group or substituted alkyl group has up to 12 carbon atoms.

11. The developer composition for high contrast diffusion transfer photographic materials as claimed in claim 10 where any substituted alkyl group is selected from the group consisting of hydroxyl, carboxyl, acyl or aryl substituted alkyl groups having up to 12 total carbon atoms.

12. In a photographic silver salt diffusion transfer development process, the improvement of forming positive images of litho-type photographic characteristics by using a developer composition comprising (1) a developing agent,
(2) a silver halide solvent,
(3) an alkaline agent,
(4) an amino compound represented by the following formula Ia, Ib or Ic or a mixture thereof, and
(5) a mercapto-group free imidazole compound represented by the following formula II or a mixture thereof:

Formula I (a) $NH_2—C_mH_{2m}—X$ wherein X represents a hydrogen atom, a hydroxyl group, a carboxyl group or an amino group, and m represents a natural number of 0–12, but X represents a hydroxyl group when m is 0,

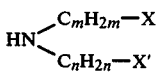

wherein X and X' each represents a hydrogen atom, a hydroxyl group, a carboxyl group or an amino group, and m and n represent each a natural number of 0–12, but X and/or X' represents a hydroxyl group when m and/or n is 0,

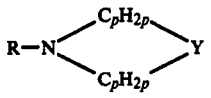

wherein Y represents an oxygen atom, —$CH_2$— or NR', R and R' each represents a hydrogen atom, an acyl group, an alkyl group or a substituted alkyl group, and p represents 2 or 3, Formula II

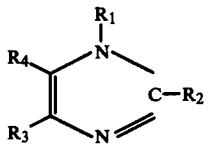

wherein $R_1$ represents a hydrogen atom, an alkyl group, a substituted alkyl group, a vinyl group or an allyl group, $R_2$ represents a hydrogen atom, an alkyl group or a substituted alkyl group, $R_3$ represents a hydrogen atom or an alkyl group, and $R_4$ represents a hydrogen atom, an alkyl group or a substituted alkyl group.

13. The photographic silver salt diffusion transfer development process of claim 12 where the total amount of the amino compound of the formula I and the imidazole compound of the formula II is about 1 g to about 250 g per liter of developer.

14. The photographic silver salt diffusion transfer development process of claim 12 where the amount is 10 to 150 g per liter of developer.

15. The photographic silver salt diffusion transfer development process of claim 12 where the content of the amino compound of the formula I is 40–98% and the content of the imidazole compound of the formula II is 60–2%, by weight of the total weight of the amino compound and the imidazole compound.

16. The photographic silver salt diffusion transfer development process of claim 15 where the pH of the developer composition is 9.0 to 13.

17. The photographic silver salt diffusion transfer development process of claim 12 where the developing agent is present in an amount of from 1.01–70, the silver halide solvent is present in an amount of from 1–100 and the alkaline agent is present in an amount of from 1–100, all in g per liter of developer composition.

18. The photographic silver salt diffusion transfer development process of claim 17 where the developing agent comprises (1) a 3-pyrazolidone or an aminophenol compound and (2) a polyhydroxybenzene, present in an amount of 0.01–20 of (1) and 1–50 of (2), all in g per liter of developer composition.

19. The photographic silver salt diffusion transfer development process of claim 18 where the 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone and 1-p-chloro-phenyl-3-pyrazolidone, the aminophenol compound is selected from the group consisting of N-methyl-p-aminophenol, p-aminophenol, 2,4-diaminophenol, p-benzylaminophenol, 2-methyl-p-aminophenol and 2-hydroxymethyl-p-aminophenol and the polyhydroxybenzene compound is selected from the group consisting of hydroquinone, catechol, chlorohydroquinone, pyrogallol, bromohydroquinone, isopropylhydroquinone, toluhydroquinone, methylhydroquinone, 2,3-dichlorohydroquinone, 2,5-dimethyl-hydroquinone and 2,3-dibromo-hydroquinon.

20. The photographic silver salt diffusion transfer development process of claim 12 where any alkyl group or substituted alkyl group present renders said compound water-soluble.

21. The photographic silver salt diffusion transfer development process of claim 20 where the alkyl moiety of any alkyl group or substituted alkyl group has up to 12 carbon atoms.

22. The photographic silver salt diffusion transfer development process of claim 21 where any substituted alkyl group is selected from the group consisting of hydroxyl, carboxyl, acyl or aryl substituted alkyl groups.

23. The developer composition as claimed in claim 1 where the images hava a gamma value of at least 8.

24. The developer composition as claimed in claim 23 where said gamma value is 8 to 19.

25. The photographic silver salt diffusion transfer development process of claim 12 which comprises image-wise exposing a photographic silver halide element, and thereafter developing the exposed silver halide in said element and transferring the unexposed silver halide as a silver complex salt to an image receiving element to thereby form a positive image in said image receiving element.

* * * * *